US008556779B2

(12) United States Patent
Grind

(10) Patent No.: US 8,556,779 B2
(45) Date of Patent: Oct. 15, 2013

(54) EXERCISE DEVICE WITH GLIDING FOOTLINK PIVOT GUIDE

(75) Inventor: Steven M. Grind, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 1128 days.

(21) Appl. No.: 12/317,586

(22) Filed: Dec. 29, 2008

(65) Prior Publication Data

US 2010/0167878 A1 Jul. 1, 2010

(51) Int. Cl.
*A63B 22/00* (2006.01)
*A63B 22/04* (2006.01)
*A63B 71/00* (2006.01)

(52) U.S. Cl.
USPC ..... 482/52; 482/51

(58) Field of Classification Search
USPC ..... 482/51, 52, 53, 57, 70, 71, 79, 80; D21/668, 670
See application file for complete search history.

(56) References Cited

U.S. PATENT DOCUMENTS

| | | | | |
|---|---|---|---|---|
| 5,919,118 | A | 7/1999 | Stearns et al. | 482/51 |
| 6,019,709 | A * | 2/2000 | Piaget | 482/70 |
| 6,152,859 | A | 11/2000 | Stearns | 482/52 |
| 6,165,107 | A * | 12/2000 | Birrell | 482/70 |
| 6,196,948 | B1 | 3/2001 | Stearns et al. | 482/52 |
| 6,277,054 | B1 | 8/2001 | Kuo | 482/51 |
| 6,361,476 | B1 | 3/2002 | Eschenbach | 482/52 |
| 6,840,892 | B1 | 1/2005 | Wu | 482/51 |
| 7,041,036 | B1 * | 5/2006 | Kuo | 482/52 |
| 7,104,929 | B1 | 9/2006 | Eschenbach | 482/52 |
| 7,121,984 | B1 | 10/2006 | Hong | 482/52 |
| 7,179,201 | B2 * | 2/2007 | Rodgers, Jr. | 482/52 |
| 7,214,168 | B2 * | 5/2007 | Rodgers, Jr. | 482/52 |
| 7,377,881 | B2 | 5/2008 | Moon | 482/52 |
| 2001/0036886 | A1 | 11/2001 | Eschenbach | 482/142 |
| 2002/0128122 | A1 * | 9/2002 | Miller | 482/52 |
| 2004/0224825 | A1 | 11/2004 | Giannelli et al. | 482/52 |
| 2004/0248707 | A1 * | 12/2004 | Rodgers, Jr. | 482/83 |
| 2005/0124466 | A1 | 6/2005 | Rodgers, Jr. | 482/52 |
| 2005/0124467 | A1 | 6/2005 | Rodgers, Jr. | 482/52 |
| 2006/0172862 | A1 * | 8/2006 | Badarneh et al. | 482/52 |
| 2006/0199702 | A1 | 9/2006 | Eschenbach | 482/52 |
| 2006/0217234 | A1 | 9/2006 | Rodgers et al. | 482/52 |
| 2006/0234838 | A1 | 10/2006 | Dalebout et al. | 482/57 |
| 2007/0032348 | A1 | 2/2007 | Hong | 482/52 |
| 2007/0087906 | A1 | 4/2007 | Rodgers, Jr. | 482/52 |
| 2007/0087907 | A1 | 4/2007 | Rodgers, Jr. | 482/52 |
| 2007/0219061 | A1 | 9/2007 | Rodgers, Jr. | 482/52 |
| 2007/0219062 | A1 | 9/2007 | Rodgers, Jr. | 482/52 |
| 2007/0232457 | A1 | 10/2007 | Porth | 482/51 |
| 2007/0298936 | A1 | 12/2007 | Ohrt et al. | 482/52 |
| 2008/0051260 | A1 | 2/2008 | Simonson et al. | 482/52 |
| 2008/0064572 | A1 | 3/2008 | Nardone | 482/52 |
| 2008/0269024 | A1 * | 10/2008 | Lin | 482/52 |
| 2009/0069158 | A1 * | 3/2009 | Hsu | 482/52 |

* cited by examiner

*Primary Examiner* — Oren Ginsberg
(74) *Attorney, Agent, or Firm* — Terence P. O'Brien; Todd A. Rathe

(57) ABSTRACT

An exercise device includes a foot link that glides between a set of guides. At least one guide of the set of guides pivots to raise and lower the foot link.

23 Claims, 5 Drawing Sheets

EXERCISE DEVICE WITH GLIDING FOOTLINK PIVOT GUIDE

BACKGROUND

Most exercise devices provide a fixed predetermined exercise path of motion. Some exercise devices now provide a user-defined exercise path of motion. However, such exercise devices utilize structural elements that are cantilevered, increasing structural rigidity requirements and increasing overall weight of the exercise device. Other such exercise devices provide exercise paths of motion having a less than desirable feel.

DETAILED DESCRIPTION OF THE EXAMPLE EMBODIMENTS

Figure 1:
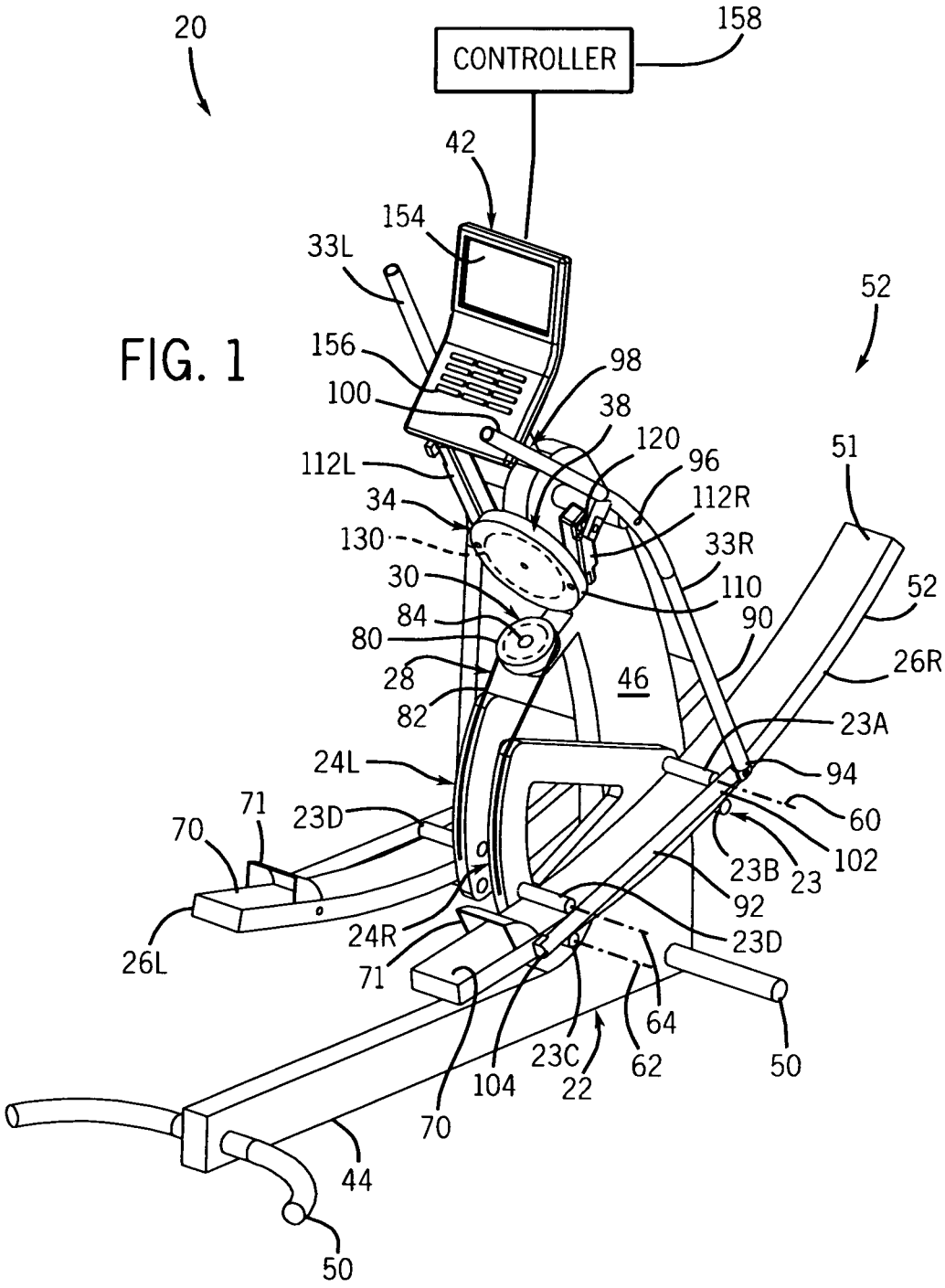
FIG. 1 is a rear perspective view of an exercise device according to an example embodiment.

FIGS. 1-5 illustrate exercise device 20 according to an example embodiment. As will be described hereafter, exercise device 20 provides a person exercising with a plurality of user selectable motion paths. The user is able to change between different available paths by simply applying different forces to foot links of the exercise device. Exercise device 20 provides such freedom of motion with relatively few, if any, cantilevered structural elements. As a result, the structural rigidity and the overall weight of exercise device 20 may be reduced. In addition, exercise device 20 provides user selectable paths of motion which have an enhanced user feel.

Exercise device 20 includes frame 22, guides 23A, 23B, 23C and 23D (collectively referred to as guides 23), pivot supports 24R and 24L (collectively referred to as pivot supports 24), tracks or foot links 26R, 26L (collectively referred to as foot links 26), foot link vertical synchronizer 28, vertical variable resistance source 30, swing arms 33R, 33L (collectively referred to as swing arms 33), foot link horizontal synchronizer 34, horizontal variable resistance source 38 and control panel 42. Frame 22 comprises one or more structures fastened, bonded, welded or integrally formed with one another to form a base, foundation or main support body configured to support remaining components of exercise device 20. Portions of frame 22 further serve to assist in stabilizing exercise device 20 as well as to provide structures that a person exercising may engage or grasp when mounting or de-mounting exercise device 20.

As shown by FIG. 1, frame 22 includes base 44 and front upright 46. Base 44 comprises one or more structures extending along a bottom of exercise device 20 configured to support exercise device 20 upon a support surface, floor, foundation and the like. Base 44 includes outwardly extending feet, pedestals or extensions 50 which further assist in stabilizing exercise device 20. In other embodiments, base 44 may have other configurations.

Front upright 46 comprises one or more structures providing a column, post, stanchion or the like extending upwardly from base 44 at a forward or front end 52 of exercise device 20. Upright 46 is couple 2 and supports the remaining components of exercise device 20 including guides 23 and pivot supports 24. Upright 46 pivotally supports pivot supports 24. In other embodiments, upright 46 may have other configurations. In still other embodiments, upright 46 may be omitted.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Guides 23 comprise structures which guide gliding movement of foot links 26. In the example illustrated, guides 23 comprise rods, rollers or other structures engaging opposite surfaces of foot links 26. Guides 23 are configured such that foot may glide or slide between such guides 23 as they reciprocate in forward and rearward directions.

In the example illustrated, exercise device 20 includes four guides 23 for each of tracks 26. For each of tracks 26, exercise device 20 includes guides 23A-23D. Guides 23A project from opposite sides of upright 46 and engage a top surface 51 of tracks 26. Guides 23B extend from opposite sides of upright 46 and engage or slightly contact a bottom surface 52 of foot links 26. Guides 23C extend from pivot supports 24 and slidably contact bottom surface 52 of foot links 26. Guides 23D extend outwardly from pivot supports 24 and slidably contact top surface 51 of tracks 26. Guides 23 allow tracks 26 to slide or glide therebetween while being supported by guides 23.

According to one embodiment, guides 23A and 23D are spaced from one another by a distance of between about 30 inches and 48 inches, and nominally about 32 inches. Guides 23B and 23C are spaced from one another by a distance of between about 30 inches and 48 inches, and nominally about 32 inches. This spacing has been found to provide a smooth and stable glide and feel for foot links 26. In other embodiments, other spacings may be used.

Pivot supports 24 comprise structures configured to pivotably support at least one of guides 23 so as to raise and lower that portion of one of the links 26 that is supported by the guide. In the example illustrated, pivot supports 24 each comprise wedge-shaped structures pivotably coupled to upright 46 about axis 60 while supporting guides 23C and 23D which extend along axes 62 and 64, respectively. As will be described hereafter, the wedge shape of pivot supports 24 is well-suited for vertical synchronizer 28. As pivot supports 24 pivot about axis 60, guides 23C are raised and lowered to raise and lower engaged portions of foot links 26.

Foot links 26 comprise elongated curved or arcuate members having a top surface 51 and a bottom surface 52. Foot links 26 are configured to slide or glide between guides 23. Foot links 26 each include a footpad 70 upon which a person rests or positions his or her feet and applies force to the links 26. Although illustrated as a generally flat surface, each footpad 70 may alternatively be provided with additional structures for allowing a person's foot to grip or apply force to foot link 26. For example, each of foot pads 70 may additionally include a textured surface or a high friction surface. In the example illustrated, foot pads 70 additionally include toe clips or toe cups 71. In other embodiments, toe clips 71 may be omitted.

Although exercise device 20 is illustrated as having the depicted four guides 23 for each foot link 26 and the depicted pivot supports 24, exercise device 20 may have other configurations as well. For example, although guides 23A and 23B as well as guides 23C and 23C are illustrated as extending substantially opposite to one another, in other embodiments, such guides may be offset from one another. Although guides 23A are illustrated as extending substantially along axis 60, the same axis about which pivot supports 24 pivot or rotate, in other embodiments, guides 23A may extend along an axis distinct from axis 60.

Although exercise device 20 is illustrated as including both guides 23C and 23D for additional stabilization and foot link guidance, in other embodiments, guides 23D may be omitted. Likewise, guides 23B may be omitted in some embodiments. In other embodiments where footpads 70 are located between the forward pair of guides 23A and 23B and the rearward pair of guides 23C and 23D, one or both of guides 23A and 23D may be omitted. Although guides 23 are illustrated as comprising rollers or rotationally fixed rods, in other embodiments, guides 23 may have other configurations. For example, guides 23 may comprise one or more structures forming channels or openings through which the links 26 slide or glide. Although guides 23A and 23B are illustrated as being substantially stationary, in other embodiments, guides 23A and 23B may also be supported by pivot supports 24, wherein guides 23A and 23B pivot about a much smaller radius with respect to axis 60 as compared to guides 23C and 23D. Although pivot supports 24 are illustrated as being wedge-shaped, in other embodiments, pivot supports 24 may have other shapes and configurations.

A s shown by FIG. 1, foot links 26 are curved and are substantially parallel with one another in forward and aft directions. Because foot links 26 are curved or arcuate, foot links 26 and footpad 70 move in a curved or arcuate path as foot links 26 are reciprocated back and forth. It has been found that this arcuate path provides a person exercising with a smoother or desirable feel. According to one embodiment, the links 26 each have the same radius of curvature of between about 32 inches and about 60 inches. In other embodiments, portions of each of foot links 26 may have different radius is of curvature with respect to one another. For example, in one embodiment, a front portion of each of foot links 26 may flatten out so as to have a greater radius of curvature as compared to the rear portion. In another embodiment, a rear portion of each of foot links 26 may flatten out so as to have a greater radius of curvature as compared to the front portion.

Foot link vertical synchronizer 28 comprises a mechanism configured to synchronize vertical movement of foot links 26. In particular, synchronizer 28 synchronizes the movement such that when foot link 26R is rising, foot length 26L is falling, and vice versa. In the example illustrated, foot link vertical synchronizer 28 synchronizes pivotal movement of pivot supports 24 about axis 60. In particular, synchronizer 28 synchronizes the movement such that when pivot support 24R is pivoting in a clockwise correction, pivot support 24L is pivoting in a counter-clockwise direction and vice versa.

As shown by FIG. 1, foot link vertical synchronizer 28 includes pulley 80 and cable 82. Pulley 80 is rotationally supported by upright 46. Cable 82 partially extends about pulley 80 and is connected to each of pivot supports 24. The curved side of pivot supports 24 allows cable 82 to smoothly wrap about pivot supports 24 as they pivot about axis 60. In other embodiments, foot link vertical synchronizer 28 may have other configurations.

Vertical variable resistance source 30 comprises a source of controllable and adjustable resistance against the raising and lowering of foot links 26. In the example illustrated, vertical resistance source 30 comprises an Eddy brake system. In particular, vertical resistance source 30 includes a magnet 84 (schematically shown) positioned opposite to pulley 80, wherein pulley 80 is formed from a ferrous or ferromagnetic material.

Magnet 84 comprises a magnetic member configured and located so as to apply a magnetic field to pulley 80. In the example illustrated, magnet 84 extends generally opposite to a face of pulley 80. The magnetic field applied to pulley 80 by magnet 84 creates eddy currents that themselves create opposing magnetic fields that resist relative rotation of pulley 80. By resisting relative rotation of pulley 80, pivoting of pivot supports 24 is also resisted. As a result vertical up and down movement of tracks 26 is resisted.

The resistance applied by magnet 84 is adjustable and selectable by a person exercising. In one embodiment, magnet 84 comprises an electro-magnet, wherein electrical current transmitted through magnet 84 may be varied to adjust the magnetic field and the degree of resistance provided by source 30. In one embodiment, the electrical current transmitted to magnet 84 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by magnet 84 may be adjustable by physically adjusting a spacing or gap between pulley 80 and magnet 84. For example, in one embodiment, source 30 may include an electric solenoid, voice coil or other mechanical actuator configured to move one of pulley 80 or magnet 84 relative to one another so as to adjust the gap. In yet another embodiment, pulley 80 may include a magnet positioned opposite to a stationary ferrous or ferromagnetic member.

Swing arms 33 comprise elongated structures or assemblies of structures coupled to foot 26 so as to swing, pivot or otherwise move with the movement of foot links 26. Swing arms 33 facilitate exercisable person's upper body and arms in synchronization with the exercise of the person's lower body or legs. Swing arms further transmit motion to foot link horizontal synchronizer 34 to synchronize the forward and rearward movement foot link 26R with the rearward and forward movement of foot link 26L. In other embodiments where other means are provided for synchronizing movement of foot links 26, swing arms 33 may be omitted or may be disconnectable from foot links 26 so as to be mounted to frame 22 in a stationary position.

In the example illustrated, each of swing arms 33 includes a main arm 90 and an intermediate link 92. Each main arm 90 has a first end portion 94 pivotally connected to an associated intermediate link 92, a second intermediate portion 96 pivotally connected to upright 46 of frame 22 and a third end portion 98 providing a handgrip 100. Handgrip 100 is configured to be grasped by a person during exercise. In the example illustrated, handgrip 100 comprise columns, wraps, bands, rings or other surface areas of soft, compressible, high friction, rubber-like foam or polymeric material. In other embodiments, handgrip 100 may be omitted or may be generally indistinguishable from a remainder of swing arm 33.

Intermediate link 92 comprise elongated link having a first end portion 102 pivotally connected to portion 94 of one of swing arms 33 and a second end portion 104 pivotally connected to one of foot links 26. Intermediate links 92 transmit motion between footpads 32 and main arms 90 of swing arms 33. In other embodiments, each of swing arms 33 may have other configurations. For example, each of swing arms 33 may include additional linkages.

Horizontal synchronizer 34 comprises a mechanism configured to synchronize horizontal or fore and aft movement of foot links relative to one another. In particular, horizontal synchronizer 34 is configured to synchronize forward and rearward movement of foot link 26R with rearward and forward movement of foot link 26L. In the example illustrated, synchronizer 34 includes rocker arm 110 and synchronizer links 112L and 112R. Rocker arm 110 comprises a structure pivotally connected to upright 46 of frame 22 for pivotal movement about an axis substantially perpendicular to the axis about which main arms 90 of swing arms 33 pivot. In the example illustrated, rocker arm 110 comprises a wheel or disk. In other embodiments, rocker 110 may comprise an along elongate, more linear structure, arm or member.

Figure 2:
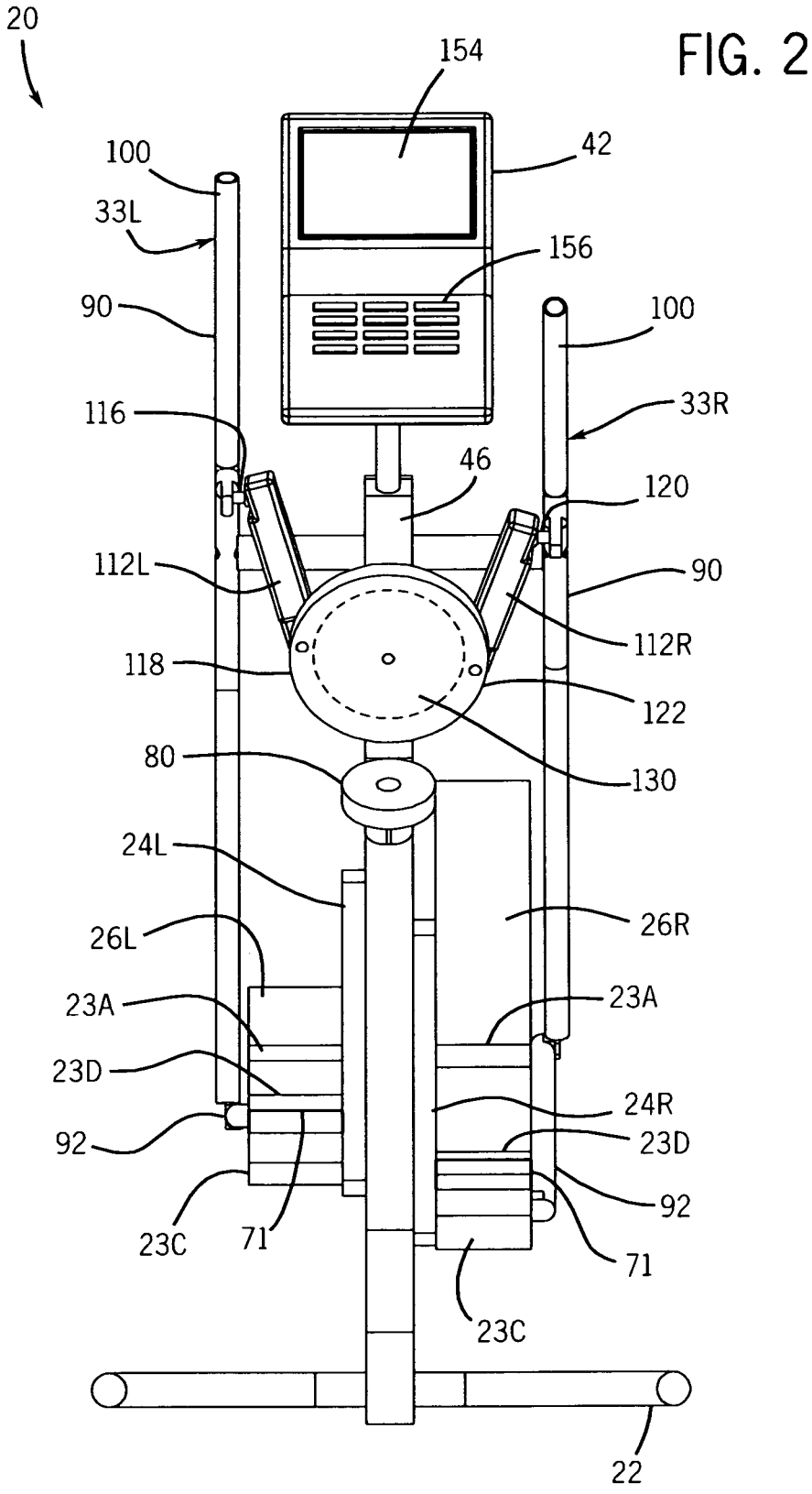
FIG. 2 is a rear elevational view of the exercise device of FIG. 1.
Figure 3:
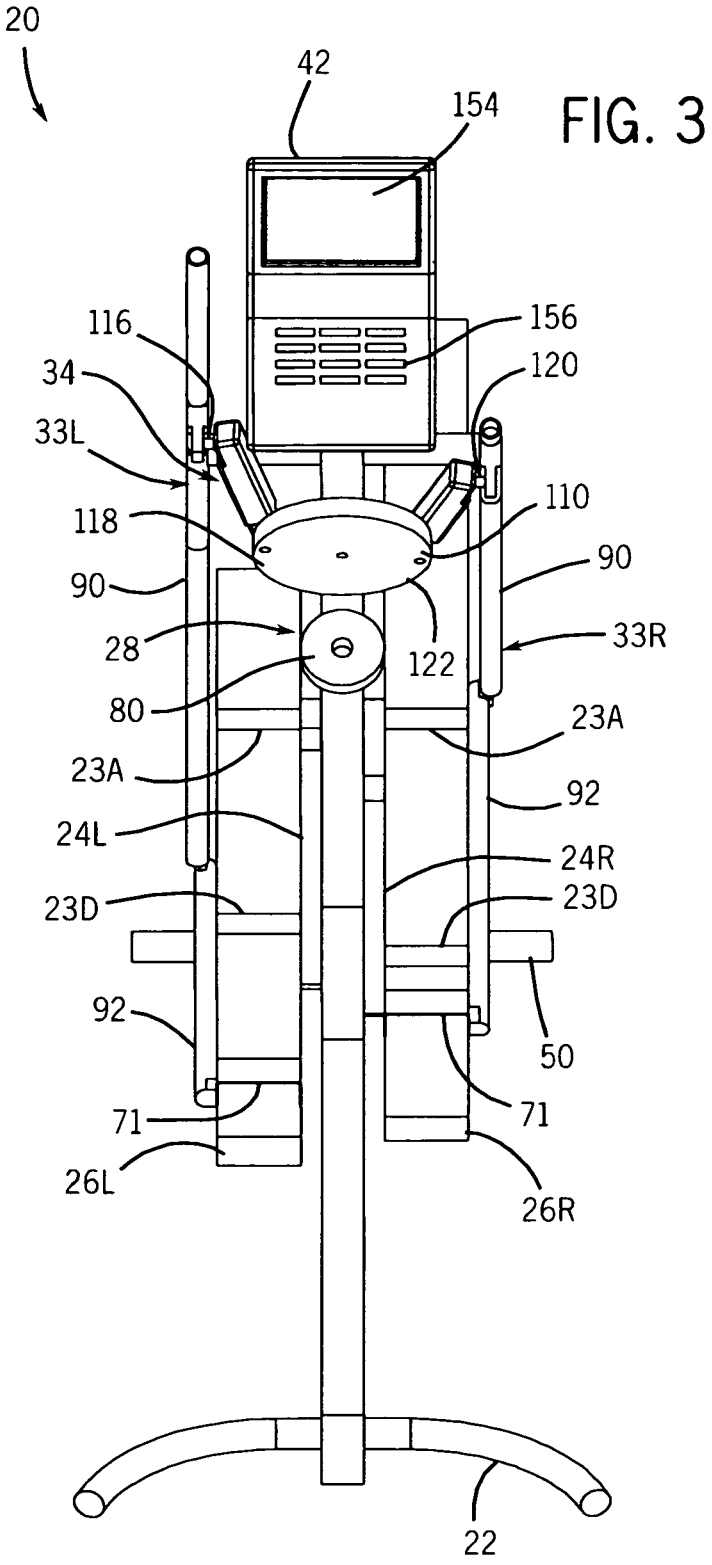
FIG. 3 is a top perspective view of the exercise device of FIG. 1.

As the shown in FIG. 2, synchronizer link 112L comprise a linkage having a first end 116 pivotally connected to main arm 90 of swing arm 33L on a first side of the pivot axis of rocker arm 110 and a second end 118 pivotally connected to rocker arm 110 on a second side of the pivot axis of rocker arm 110. As best shown in FIG. 2, synchronizer link 112R comprises a linkage having a first end 120 pivotally connected to main arm 90 of swing arm 33R and a second end 122 pivotally connected to rocker arm 110 on a second side of the pivot axis of rocker arm 110. As a result of this construction, when footpad 32L is moving forwardly, footpad 32R must move rearwardly and vice versa. With this construction, footpad synchronizer 32 utilizes structural components or linkages already provided by swing arms 33, reducing the number of parts and complexity of footpad synchronizer 34. In other embodiments, other mechanisms may be utilized to synchronize movement of footpads 32. For example, other mechanisms not connected to swing arms 33 may be utilized to synchronize movement of foot links 26.

Horizontal resistance source 38 comprises a source of controllable and adjustable resistance against the forward and rear word movement of footpads 32. In the example illustrated, horizontal resistance source 38 comprises an Eddy brake system. In particular, horizontal resistance source 38 includes a magnet 130 (schematically shown) positioned opposite to a ferromagnetic or ferrous rocker arm 110.

Magnet 130 comprises a magnetic member configured and located so as to apply a magnetic field to rocker arm 110. In the example illustrated, magnet 130 extends generally opposite to a face of rocker arm 110. The magnetic field applied to rocker arm 110 by magnet 130 creates eddy currents that themselves create opposing magnetic fields that resist relative rotation are pivotal movement of rocker arm 10. By resisting relative rotation of rocker 110, pivotal movement of swing arms 33 and horizontal movement of foot links 26 is also resisted.

In the example illustrated, rocker arm 110 serves as a the ferromagnetic member in which Eddy currents are created. In other embodiments, a separate ferromagnetic member may be mounted to rocker arm 110 so as to rotate or pivot with rocker arm 110 relative to magnet 130. Although magnet 130 is stationarily supported by upright 46 opposite to the ferromagnetic or ferrous rocker arm 110, in other embodiments, magnet 130 may be coupled to and carried by rocker arm 110 so as to rotate in response to rocking of rocker arm 110, while a separate ferromagnetic member is supported by upright 46 in a stationary manner opposite to magnet 130. Because horizontal resistance source 38 utilizes already existing components of footpad synchronizer 34 and swing arms 33, the number of parts, the volume or space consumed by resistance source 38 and complexity are reduced. In other embodiments, horizontal resistance source 38 may have other configurations. In other embodiments, horizontal resistance source 38 may alternatively not utilize components of one or both of synchronizer 34 or swing arms 33.

In the example illustrated, the resistance applied by magnet 130 is adjustable and selectable by a person exercising. In one embodiment, magnet 130 comprises an electromagnet, wherein electrical current transmitted through magnet 130 may be varied to adjust the magnetic field and the degree of resistance provided by source 38. In one embodiment, the electrical current transmitted to magnet 130 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by magnet 130 may be adjustable by physically adjusting a spacing or gap between the ferromagnetic or ferrous rocker arm 110 and magnet 130. For example, in one embodiment, source 30 may include an electric solenoid, voice coil or other mechanical actuator configured to move one of rocker arm 110 or magnet 130 relative to one another so as to adjust the gap.

Control panel 42 comprises a panel by which a person exercising may view current settings of exercise device 20 and may adjust the current settings of exercise device 20. Control panel 42 may additionally provide a person excising with feedback as to his or her exercise routine, such as duration, calories burned and the like, or may provide the person exercising with instructions or objectives for an upcoming exercise routine are workout. In the example illustrated, control panel 42 includes display 154, input 156 and controller 158. Display 154 comprises a display configured to present information to a person excising. Display 154 may comprise a liquid crystal display, an array of light emitting diodes or other devices for providing visual information.

Input 156 comprises one or more mechanisms by which a person excising may enter selections are commands. Input 156 may comprise a touchpad, a touch screen, toggle switches, one or more buttons, a mouse pad, a scroll wheel, a slider bar or various other input devices. Controller 158 comprises one or more processing units connected to display 184 and input 156 as well as vertical resistance source 30 and horizontal resistance source 38. Controller 188 may also be connected to one or more sensors (not shown). Based on information received from resistance sources 30 and 38, and the one or more sensors, controller 158 may generate control signals directing display 154 provide a person exercise with feedback as to his or her exercise routine or current settings of exercise device 20.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 158 may be embodied as part of one or more application-specific integrated circuits (ASICs). Unless otherwise specifically noted, the controller is not limited to any specific combination of hardware circuitry and software, nor to any particular source for the instructions executed by the processing unit. Based upon input received from input 156, controller 158 may generate control signals adjusting the resistance applied by resistance source 30 or resistance source 38. Such changes or adjustments may alternatively be made in response to stored programs or exercise routines associated with a memory of controller 158 or received by controller 158 through wired or wireless connections. In still other embodiments, display panel 42 may be omitted.

Figure 4:
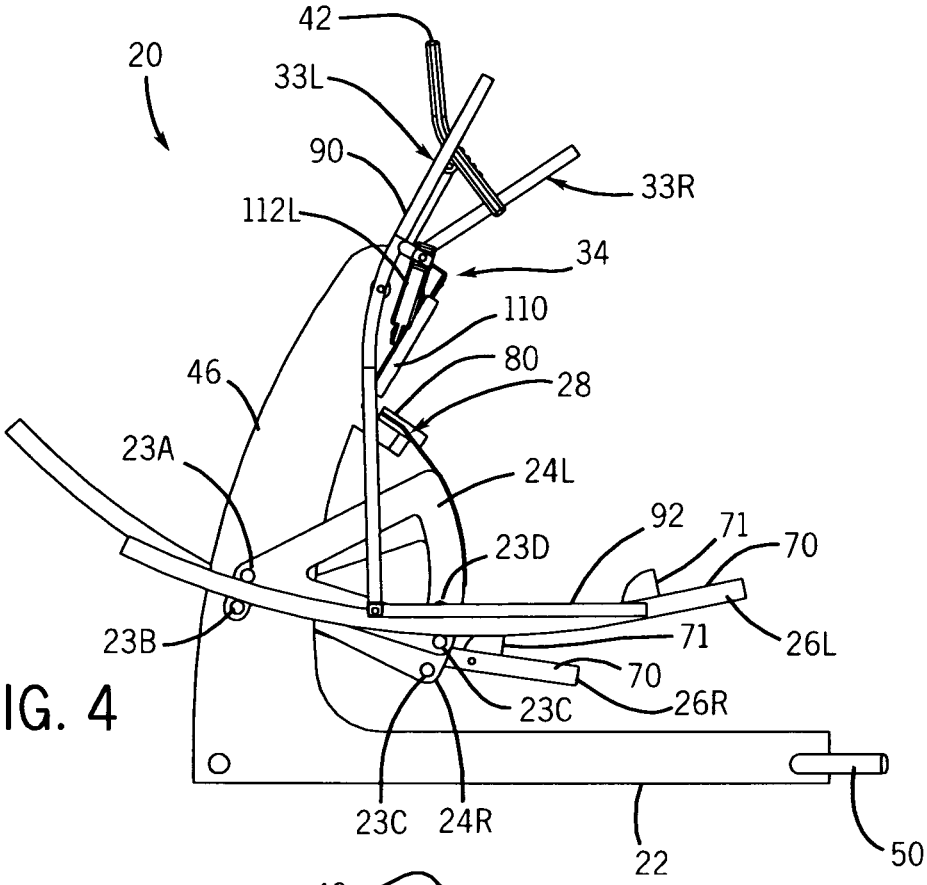
FIG. 4 is a left side elevation of view of the exercise device of FIG. 1.
Figure 5:
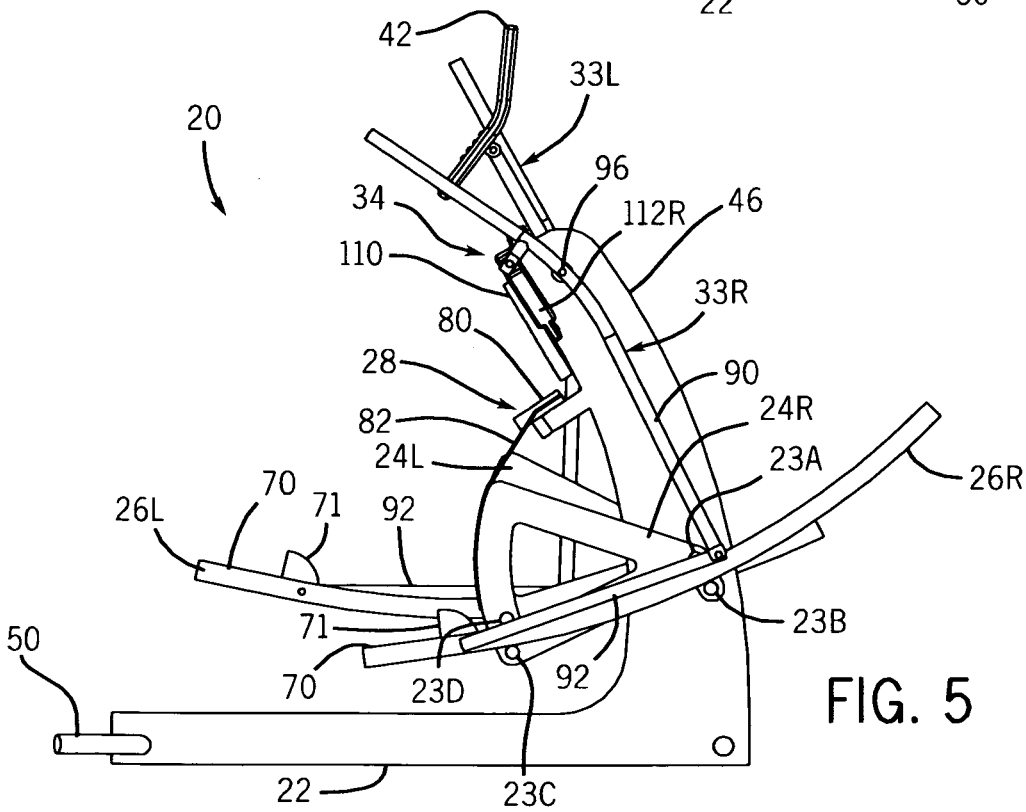
FIG. 5 is a right side elevation of view of the exercise device of FIG. 1.
Figure 6:
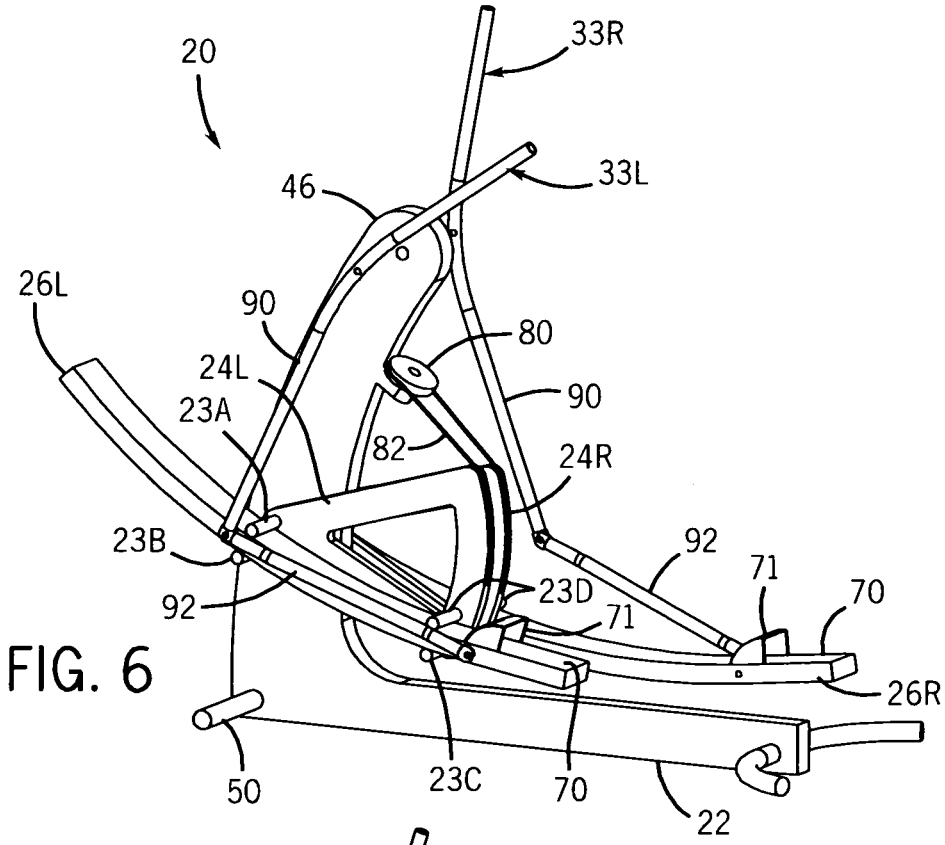
FIG. 6 is a left side perspective view of the exercise device of FIG. 1 illustrating footpads in different positions than those shown in FIG. 1.
Figure 7:
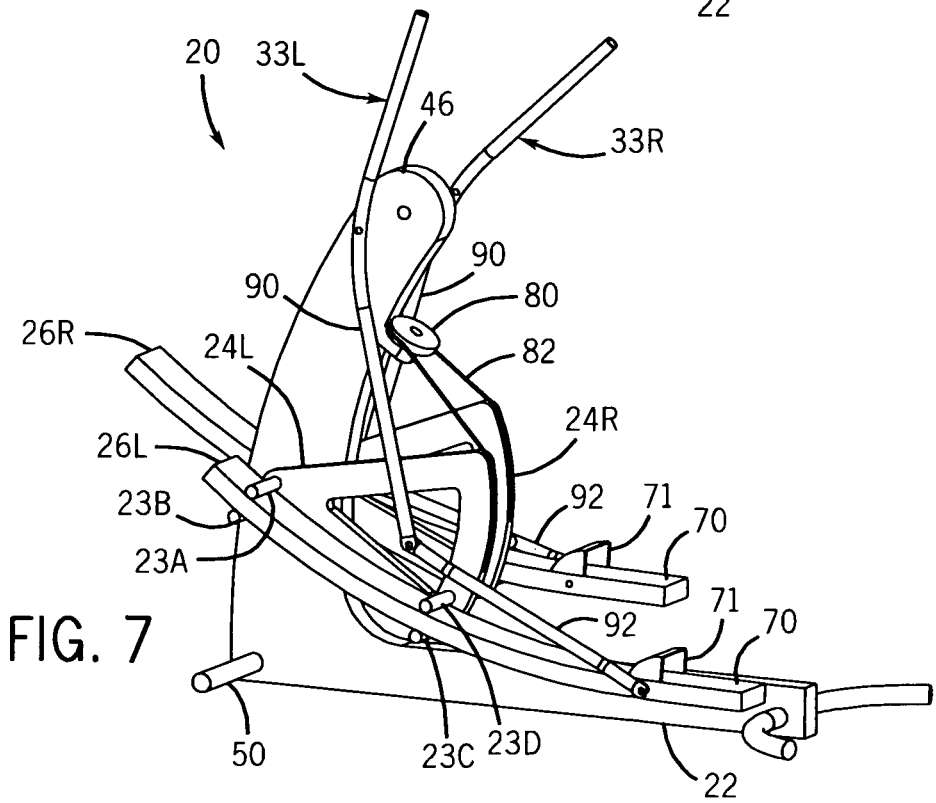
FIG. 7 is a left side perspective view of the exercise device of FIG. 1 illustrating footpads in different positions than those shown in FIGS. 1 and 6.

FIGS. 4, 6, and 7 illustrate exercise device 20 with the foot links 26 and their footpads 70 at various positions along different exercise paths of motion. FIG. 4 illustrates footpad 70 the same position shown in FIGS. 1-3 and 5. In FIG. 4, footpad 70 of foot link 26L is rearward and elevated with respect to footpad 70 of foot link 26R. In FIG. 6, footpad 70 of foot link 26L is forward and at substantially the same elevation with respect to footpad 70 of foot link 26R. In FIG. 7, footpad 70 of foot link 26L is rearward and lowered with respect to footpad 70 of foot link 26R. The positions of footpad 70 shown in FIGS. 4, 6 and 7 are just a few examples of various positions at which footpads 70 may be positioned by a user. In particular, a person, during exercise, may decide to take shorter strides by exerting less forward and rearward force to tracks 26 such the tracks 26 glide between guides 23 to a lesser extent. Alternatively or additionally, a person, during exercise, may decide to take a more vertical exercise path (closer to stair climbing) by exerting a more vertical or up-and-down force to footpad 70. This would result in pivot supports 24 being pivoted about axis 60 to a greater extent. With exercise device 20, a person excising given substantial freedom in deciding whether he or she wishes to take longer or shorter strides as well is the extent to which footpads 70 vertically travel.

Overall, exercise device 20 provides a person exercising with multiple user selectable paths of motion for foot links 26 and footpad 70. A particular path a motion for foot pads 70 may be adjusted by user by the user simply applying different forces or directional forces to footpad 70 within his or her feet. Such changes in the motion paths may be made "on-the-fly" by the person excising during an exercise routine or workout without the person having to remove his or her hands from handgrips 98. Exercise devise automatically adapts to a person's motion or motion changes. Exercise device provides such freedom of motion with very few, if any, cantilevered members. For example, foot links 26 which support foot pads 70 are supported at opposite ends have little, if any, cantilevered portions. At the same time, foot links 26 are arcuate or curved, providing a person with a more comfortable, smooth and desirable feel as footpads 70 are moved along various motion paths. As a result, exercise device 20 provides a more solid and stable feel, may be formed from less structurally rigid materials and may be lighter in overall weight.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise device comprising:

a frame;

a first foot link having a top surface and a bottom surface, wherein the first foot link is curved;

a first guide against the top surface;

a second guide against the bottom surface and spaced from the first guide in a direction along the first foot link;

a third guide substantially opposite the first guide and against the bottom surface, wherein the first guide and the second guide are configured such that the first foot link is glidable relative to both the first guide and the second guide, wherein one of the first guide and the second guide extends along a first axis and is pivotable about a second axis different than the first axis to raise or lower a portion of the first foot link; and wherein the first foot link is configured to change between a plurality of different available paths in response to force applied by a person to the first foot link.

2. The exercise device of claim 1, wherein the first guide comprises a roller.

3. The exercise device of claim 2, wherein the second guide comprises a roller.

4. The exercise device of claim 1, wherein the first guide extends along the first axis and is pivotable about the second axis.

5. The exercise device of claim 1 further comprising a fourth guide substantially opposite the second guide and against the top surface.

6. The exercise device of claim 1 further comprising:

a second foot link having a top surface and a bottom surface, wherein the second foot link is curved;

a third guide against the top surface of the second foot link; and a fourth guide against the bottom surface of the second foot link and spaced from the third guide in a direction along the second foot link, wherein the third guide and the fourth guide are configured such that the second foot link is glidable relative to both the third guide and the fourth guide, and wherein one of the third guide and the fourth guide extends along a third axis and is pivotable about a fourth axis different than the third axis to raise or lower a portion of the second foot link.

7. The exercise device of claim 6, wherein the second axis and the fourth axis are contiguous.

8. The exercise device of claim 6 further comprising a first synchronization mechanism configured to synchronize pivoting of one of the first guide and the second guide and one of the third guide and the fourth guide in opposite directions.

9. The exercise device of claim 8, wherein the synchronization mechanism comprises a cable having a first end coupled to said one of the first guide and the second guide and a second end coupled to said one of the third guide and the fourth guide.

10. The exercise device of claim 9 further comprising a pulley, wherein the cable extends about the pulley.

11. The exercise device of claim 9 further comprising:

a ferromagnetic member coupled to the cable so as to be rotated by the cable; and a magnet configured to apply a magnetic field to the member to resist vertical movement of the first foot link and the second foot link.

12. The exercise device of claim 11, wherein the magnet comprises an electromagnet configured to apply a selectable magnetic field to the ferromagnetic member to provide different levels of resistance against vertical movement of the first foot link and the second foot link.

13. The exercise device of claim 8 further comprising:

an adjustable variable vertical resistance source coupled to said one of the first guide and the second guide and said one of the third guide and the fourth guide; and an adjustable variable horizontal resistance source different than the vertical resistance source and coupled to the first foot link and the second foot link.

14. The exercise device of claim 8 further comprising:

a first swing arm having a first end portion pivotably connected to the first foot link, an intermediate portion pivotably connected to the frame and a second end portion including a first handgrip; and a second swing arm having a first end portion pivotably connected to the second foot link, an intermediate portion pivotably connected to the frame and a second end portion including a second handgrip.

15. The exercise device of claim 14 further comprising a second synchronization mechanism connected to the first swing arm and the second swing arm to synchronize pivoting of the first swing arm and the second swing arm and movement of the first foot link and the second foot link in opposite directions.

16. The exercise device of claim 15 further comprising an adjustable variable horizontal resistance source connected to the second synchronization mechanism.

17. The exercise device of claim 15, wherein the first swing arm and the second swing arm pivot about a fifth axis relative to the frame and wherein the second synchronization mechanism comprises:

a rocker arm pivotally supported by the frame about a sixth axis perpendicular to the fifth axis;

a first synchronizer link having a first end pivotally connected to the first swing arm and a second end pivotally connected to a first end of the rocker arm; and a second synchronizer link having a first end pivotally connected to the second swing arm and a second end pivotally connected to a second end of the rocker arm.

18. The exercise device of claim 17 further comprising:

a ferromagnetic material provided by the rocker arm or coupled to the rocker arm so as to move in response to movement of the rocker arm; and a magnet configured to apply a magnetic field to the member to resist vertical movement of the first foot link and the second foot link.

19. The exercise device of claim 18, wherein the magnet comprises an electromagnet configured to apply a selectable magnetic field to the ferromagnetic member to provide different levels of resistance against vertical movement of the first foot link and the second foot link.

20. The exercise device of claim 1 further comprising a toe cap coupled to the first foot link.

21. The exercise device of claim 1, wherein the other of the first guide and the second guide extends along the second axis.

22. An exercise device comprising:

a frame;

a first foot link having a top surface and a bottom surface, wherein the top surface is concave and wherein the bottom surface is convex;

a first guide against the top surface;

a second guide against the bottom surface and spaced from the first guide in a direction along the first foot link, wherein the first guide and the second guide are configured such that the first foot link is glidable relative to both the first guide and the second guide, wherein one of the first guide and the second guide extends along a first axis and is pivotable about a second axis different than the first axis to raise or lower a portion of the first foot link; and wherein the first foot link is configured to change between a plurality of different available paths in response to force applied by a person to the first foot link;

a second foot link having a top surface and a bottom surface, wherein the top surface of the second foot link is concave and wherein the bottom surface of the second foot link is convex;

a third guide against the top surface of the second foot link;

a fourth guide against the bottom surface of the second foot link and spaced from the third guide in a direction along the second foot link, wherein the third guide and the fourth guide are configured such that the second foot link is glidable relative to both the third guide and the fourth guide, wherein one of the third guide and the fourth guide extends along a third axis and is pivotable about a fourth axis different than the third axis to raise or lower a portion of the second foot link; and wherein the second foot link is configured to change between a plurality of different available paths in response to force applied by a person to the second foot link.

23. An exercise device comprising:

a frame;

a first foot link having a top surface and a bottom surface;

a first guide against the top surface;

a second guide against the bottom surface and spaced from the first guide in a direction along the first foot link, wherein the first guide and the second guide are configured such that the first foot link is glidable relative to both the first guide and the second guide, wherein one of the first guide and the second guide extends along a first axis and is pivotable about a second axis different than the first axis to raise or lower a portion of the first foot link;

wherein the other of the first guide and the second guide extends along the second axis; and wherein the first foot link is configured to change between a plurality of different available paths in response to force applied by a person to the first foot link;

a second foot link having a top surface and a bottom surface;

a third guide against the top surface of the second foot link;

a fourth guide against the bottom surface of the second foot link and spaced from the third guide in a direction along the second foot link, wherein the third guide and the fourth guide are configured such that the second foot link is glidable relative to both the third guide and the fourth guide, wherein one of the third guide and the fourth guide extends along a third axis and is pivotable about a fourth axis different than the third axis to raise or lower a portion of the second foot link;

wherein the other of the third guide and the fourth guide extends along the fourth axis; and wherein the second foot link is configured to change between a plurality of different available paths in response to force applied by a person to the second foot link.

* * * * *